US012544680B2

(12) United States Patent
Huang

(10) Patent No.: US 12,544,680 B2
(45) Date of Patent: Feb. 10, 2026

(54) WATER SPLASHING TOY

(71) Applicant: Michael Huang, Shantou (CN)

(72) Inventor: Michael Huang, Shantou (CN)

( * ) Notice: Subject to any disclaimer, the term of this patent is extended or adjusted under 35 U.S.C. 154(b) by 231 days.

(21) Appl. No.: 18/218,092

(22) Filed: Jul. 4, 2023

(65) Prior Publication Data

US 2025/0010216 A1 Jan. 9, 2025

(51) Int. Cl.

| | |
|---|---|
| ***A63B 43/00*** | (2006.01) |
| ***A63H 23/10*** | (2006.01) |
| ***A63H 33/18*** | (2006.01) |

(52) U.S. Cl.

CPC ..... *A63H 23/10* (2013.01); *A63B 43/00* (2013.01); *A63H 33/18* (2013.01)

(58) Field of Classification Search

CPC ..... A63B 43/00; A63H 23/10; A63H 23/12; A63H 33/18

See application file for complete search history.

(56) References Cited

U.S. PATENT DOCUMENTS

| | | | | | |
|---|---|---|---|---|---|
| 4,212,460 | A * | 7/1980 | Kraft | A63B 65/00 | 473/577 |
| 5,277,641 | A * | 1/1994 | Gable | A63H 33/18 | 239/289 |
| 5,538,456 | A * | 7/1996 | Liu | A63H 33/30 | 473/577 |
| 5,975,983 | A * | 11/1999 | Panec | A63H 33/30 | 141/114 |
| 6,527,616 | B1 * | 3/2003 | Li | A63B 43/005 | 473/574 |
| 6,645,101 | B1 * | 11/2003 | Wong | A63B 43/00 | 473/594 |
| 6,939,193 | B1 * | 9/2005 | McDowell | A63B 67/10 | 482/110 |
| 7,481,727 | B2 * | 1/2009 | Chia | A63B 43/00 | 473/577 |
| 8,029,393 | B2 * | 10/2011 | Frazier | A63B 43/002 | 473/577 |
| 11,771,960 | B2 * | 10/2023 | Cardon | A63B 37/14 | 473/594 |
| 2011/0111896 | A1 * | 5/2011 | Frazier | A63B 43/002 | 473/611 |
| 2012/0100775 | A1 * | 4/2012 | Marciano | A63H 23/00 | 446/153 |
| 2014/0162526 | A1 * | 6/2014 | Duda, III | A63H 37/00 | 446/153 |

* cited by examiner

*Primary Examiner* — John A Ricci
(74) *Attorney, Agent, or Firm* — Che-Yang Chen

(57) ABSTRACT

A water splashing toy includes an outer shell having an inner cavity and a plurality of water passages communicated to the inner cavity, and an inner water retaining bladder disposed in the inner cavity of the outer shell. The water splashing toy is easy and convenient for quick water filling, and the toy bounces well on a user body and does not explode, so that the user will not get hurt or feel pain when playing the water splashing toy.

6 Claims, 15 Drawing Sheets

WATER SPLASHING TOY

BACKGROUND OF THE PRESENT INVENTION

Field of Invention

The present invention relates to a toy for water games, and more particularly to a water splashing toy having a relatively high water holding capacity and can be played for multiple times after a squeezing operation for water filling.

Description of Related Arts

It is entertaining and amusing to play water games for both of children and adults. Currently, many water balls, which can be filled with water for water ejection and splashing, have emerged in the market for people to play. People can enjoy and have fun by squeezing the balls in a bath tub, or using the water balls as water bombs to toss and throw to each other in a swimming pool on a summer party.

Referring to FIG. 1, a conventional water ball is shown to comprise a water balloon 1 that can be filled with water in the balloon. However, when the water balloon is hit on a person or on an environment surface, the water balloon will be cracked that it can not be reused. In addition, the explosion of the water balloon may hurt the person which has been shot on target in a water fighting game.

As shown in FIG. 2, another conventional water ball is a water soak ball 2 that is able to absorb water because of its water absorbing ability. For example, the water soak ball 2 is made of polypropylene that is an imitation wool material. However, the water soaking process of this water soak ball 2 is relatively long and the water absorption capacity is also limited.

FIG. 3 of the drawings illustrates another conventional water ball which comprises two ball halves 3 which are able to self-sealing. More specifically, the two halves 3 can be opened to define an opening for water filling, and after the two ball halves 3 are filled with water, the two ball halves 3 can automatically move toward each other, so as to seal the opening and form an integral water ball containing water therein. However, during the water fighting game, when the water ball is exploded on a person, the two ball halves 3 will bounce away from each other, so that a relatively large impact force will be exerted on the person to result in a pain to the person. In addition, in order to achieve the self-sealing performance, the two ball halves 3 should be provided with rigid magnetically attracting elements which are easy to detach and slip off from the two ball halves 3 and the bumping of the rigid magnetically attracting elements on the body of the user may result in scars on the body of the user.

SUMMARY OF THE PRESENT INVENTION

The invention is advantageous in that it provides a water splashing toy which is easy and convenient for quick water filling, so as to reduce the time for getting ready to play.

Another advantage of the present invention is to provide a water splashing toy, wherein a water holding capacity is increased by a water retaining capacity of an inner water retaining bladder and a water retaining space between the inner water retaining bladder and an outer shell.

Another advantage of the present invention is to provide a water splashing toy, wherein the outer shell can be squeezed by the user when the water splashing toy is immersed into the water, so that when the outer shell restores its shape, water can be sucked into the water splashing toy through a plurality of water passages in the outer shell due to the lower pressure cased by the squeezing of the user, so that the water filling process is fast.

Another advantage of the present invention is to provide a water splashing toy which can be played for multiple times after a single water filling step because water may residue in the inner water retaining bladder or in the water retaining space between the inner water retaining bladder and the outer shell, so that the waste of water is reduced and the user can spend more time on playing of squeezing, tossing, or throwing in a water fighting game.

Another advantage of the present invention is to provide a water splashing toy which can store and retain the water in the outer shell for multiple throws in the water fighting games, so that not only around a swimming pool or in a bath tub, the people can chase after each other and play on ground or on a lawn after the water splashing toy is filled with water.

Another advantage of the present invention is to provide a water splashing toy, wherein during the playing of the water splashing toy, the outer shell is relatively soft and will bounce well on a body of the user and does not explode, so that the user, especially the child, will not get hurt or feel pain when the water splashing toy is bumping on the body of the user.

Another advantage of the present invention is to provide a water splashing toy, wherein when the water splashing toy containing water therein is bumping on the body of the user, the inner water retaining bladder can function to provide a buffering effect to the outer shell, so as to avoid a strong impact and shock on the body of the user by the outer shell of the water splashing toy.

Another advantage of the present invention is to provide a water splashing toy, wherein the outer shell of the water splashing toy is provided with a plurality of buffering protrusions which will deform when having contact with the body of the user, so as to prevent the user to get hurt in the water splashing game.

Another advantage of the present invention is to provide a water splashing toy, wherein the manufacturing of the water splashing toy is easy, and the cost is low.

Additional advantages and features of the invention will become apparent from the description which follows, and may be realized by means of the instrumentalities and combinations particularly pointing out in the appended claims.

According to the present invention, the foregoing and other objects and advantages are attained by a water splashing toy comprising an outer shell having an inner cavity and a plurality of water passages communicated to the inner cavity, and an inner water retaining bladder disposed in the inner cavity of the outer shell.

According to another aspect of the present invention, the present invention provides a manufacturing method of a water splashing toy, comprising the following steps.

(a) Form a cavity body portion of a shell body having an inner cavity, a plurality of water passages communicated to the inner cavity, and an inserting opening communicated to the inner cavity.

(b) Dispose an inner water retaining bladder into the inner cavity of the shell body through the inserting opening.

(c) Seal the inserting opening through a sealing portion which is connected to the cavity body portion to hide the inner water retaining bladder within the shell body.

According to another aspect of the present invention, the present invention provides a manufacturing method of a water splashing toy, comprising the following steps.

(A) Form two shell sections of a shell body each having a receiving chamber, wherein at least one of the two shell sections is provided with a plurality of water passages.

(B) Dispose an inner water retaining bladder into the receiving chamber of one of the two shell sections.

(C) Integrally combine the two shell sections to define an inner cavity for hiding and receiving the inner water retaining bladder within the shell body.

According to another aspect of the present invention, the present invention provides a water splashing method comprising the following steps.

(α) Deform an outer shell and an inner water retaining bladder in the outer shell.

(β) Suck water into the outer shell through a plurality of water passages in the outer shell when the outer shell and the inner water retaining bladder restore shapes from the deformation, wherein the outer shell is capable of retaining water in the inner cavity of the outer shell and the inner water retaining bladder is capable of absorbing water, so as to increase a water holding capacity.

(γ) Allow water to splash trough the plurality of water passages when the outer shell is being bumped.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

Referring to FIGS. 4 to 8 of the drawings, a water splashing toy according a preferred embodiment of the present invention is illustrated. The water splashing toy comprises an outer shell 10 and an inner water retaining bladder 20 disposed in the outer shell 10, wherein the inner water retaining bladder 20 is capable of retaining water, e.g. absorbing water, so as to hold the water in the outer shell 10 which is made of a water-proof material.

Figure 1:
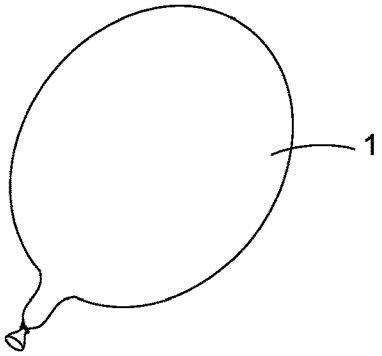
PRIOR ART FIG.1
FIG. 1 is a perspective view of a conventional water ball.
Figure 2:
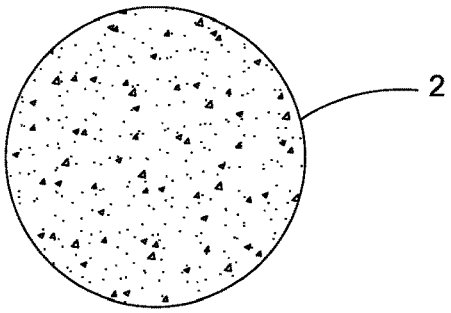
PRIOR ART FIG.2
FIG. 2 is a perspective view of another conventional water ball.
Figure 3:
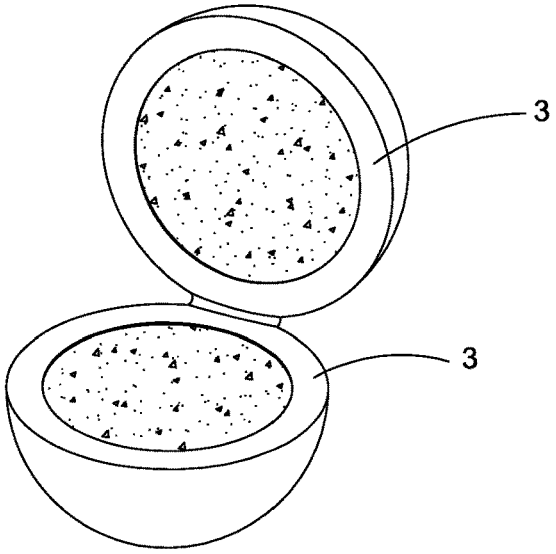
PRIOR ART FIG.3
FIG. 3 is a perspective view of another conventional water ball.
Figure 4:
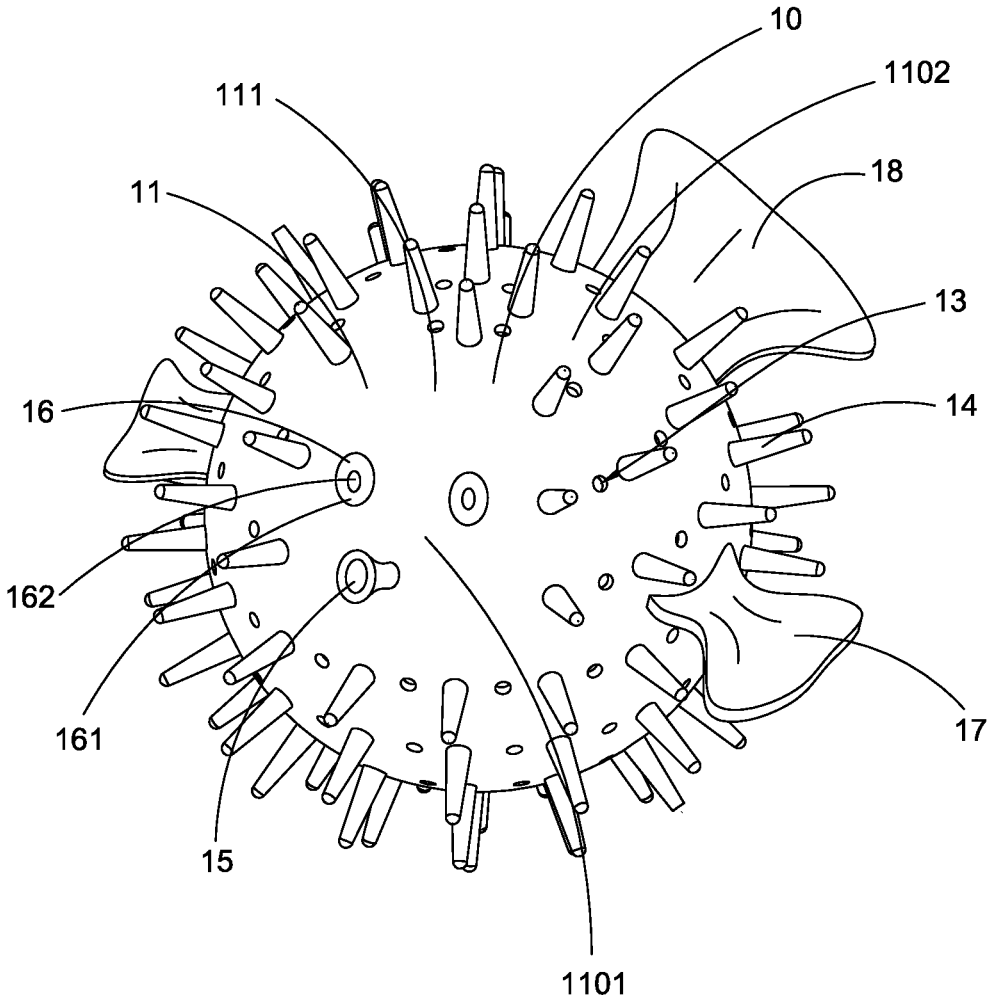
FIG. 4 is a perspective view of a water splashing toy according to a preferred embodiment of the present invention.
Figure 5:
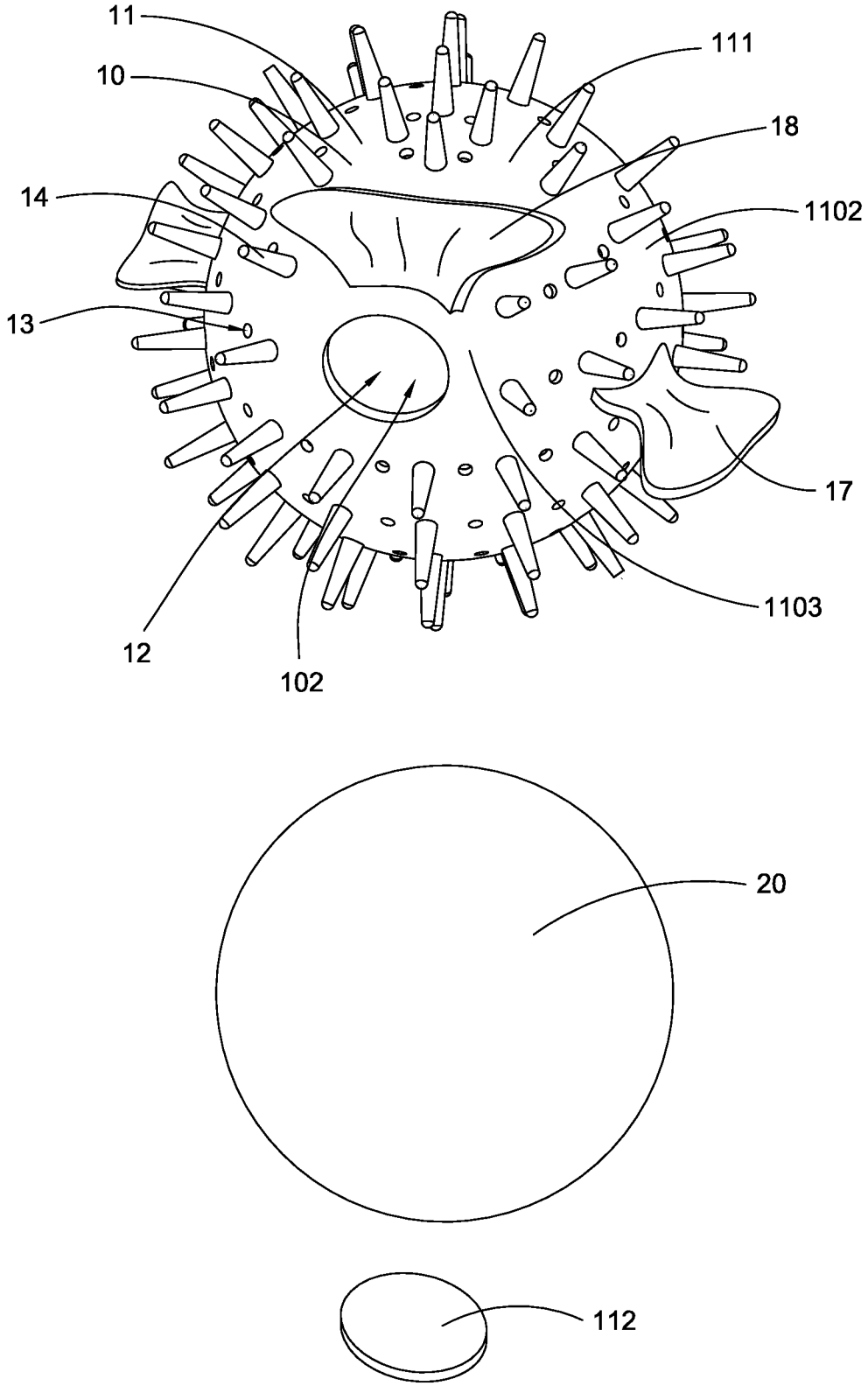
FIG. 5 is an exploded view of the water splashing toy according to the above preferred embodiment of the present invention.
Figure 6:
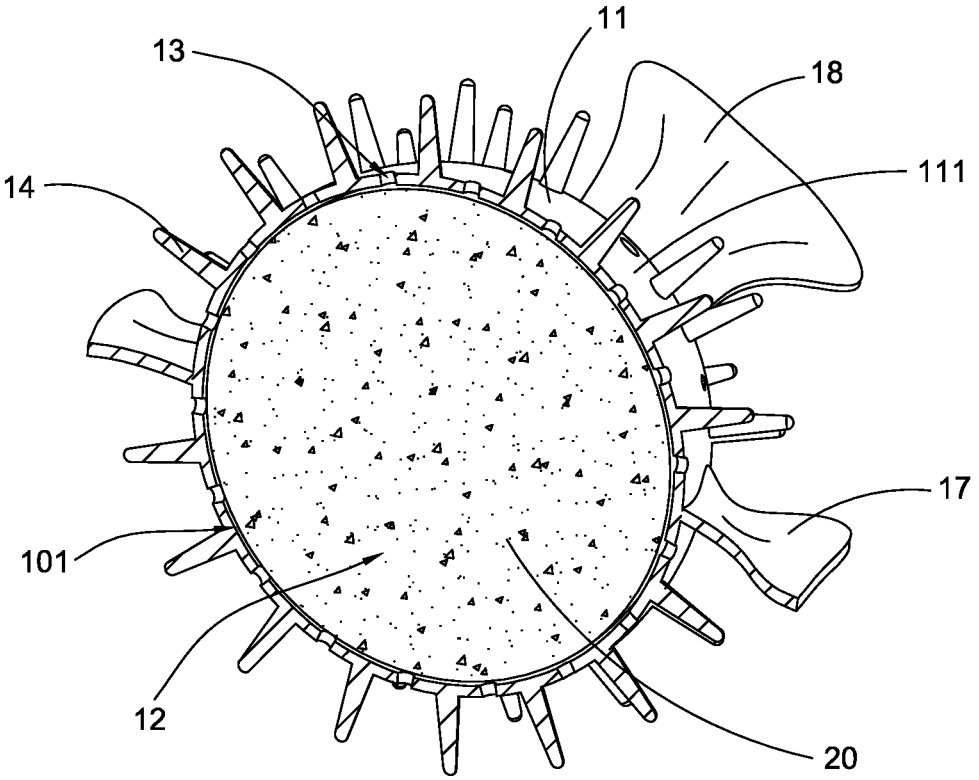
FIG. 6 is a sectional view of the water splashing toy according to the above preferred embodiment of the present invention.

More specifically, as shown in FIGS. 4 to 6, the outer shell 10 comprises a shell body 11 defining an inner cavity 12 and having a plurality of water passages 12 formed in the shell body 11, wherein the plurality of water passages 13 is communicated with the inner cavity 12 for allowing water to enter the inner cavity 12 or be squeezed out of the outer shell 10.

The inner water retaining bladder 20 is disposed in the inner cavity 12 of the shell body 11 of the outer shell 10. Accordingly, the inner water retaining bladder 20 can be just placed in the inner cavity 12 of the shell body 11 of the outer shell 10, or may be attached to an inner side of the shell body 11, so as to be integrally formed with the shell body 11.

The outer shell 10 is made of a soft and flexible material, such as silicon, rubber, gel, fabric or cloth, PE (Polyethylene), PVC (Polyvinyl Chloride), PP (Polypropylene) and TPU (Thermoplastic Urethane). Preferably, the outer shell 10 is made of silicon or gel.

The inner water retaining bladder 20 is made of a material of high water absorbing ability, such as a sponge material which is a porous material with good water absorption performance. The sponge material can be made of wood cellulose fibers or foam plastic polymers, or can be natural sponge made from sponge animals, or synthetic sponges made of material such as low-density polyether, polyvinyl alcohol, and polyester.

Alternatively, the inner water retaining bladder 20 is made of water absorbing resin such as polyacrylate, polyvinyl alcohol, vinyl acetate copolymer, polyurethane, polyethylene oxide, and starch adhesive copolymer. In addition, the inner water retaining bladder 20 also can be composite water absorbing materials mixed with other material such as rubber.

The outer shell 10 of the water splashing toy further comprises a plurality of protrusions 14 which are integrally protruded from the shell body 11. Accordingly, the plurality of protrusions 14 and the shell body 11 are made of the same soft and flexible material, so that when the water splashing toy is thrown to a body of a user, the plurality of protrusions 14 will provide a buffering effect between the body of the user and the outer shell 10 of the water splashing toy, so as to reduce the impact force exerted on the body of the user. Preferably, the plurality of protrusions 14 are radially and evenly formed on the shell body 11.

More specifically, the shell body 11 comprises a head area 1101, a middle surrounding area 1102 and an end area 1103, the plurality of protrusions 14 are formed on the middle surrounding area 1102. It is worth mentioning that a shape of each of the plurality of protrusions 14 is not limited and can be configured as a column, a pin, a ball and the like. As shown in FIGS. 4 to 6 of the drawings, each of the plurality of protrusions 14 is embodied as a conical column.

Figure 8:
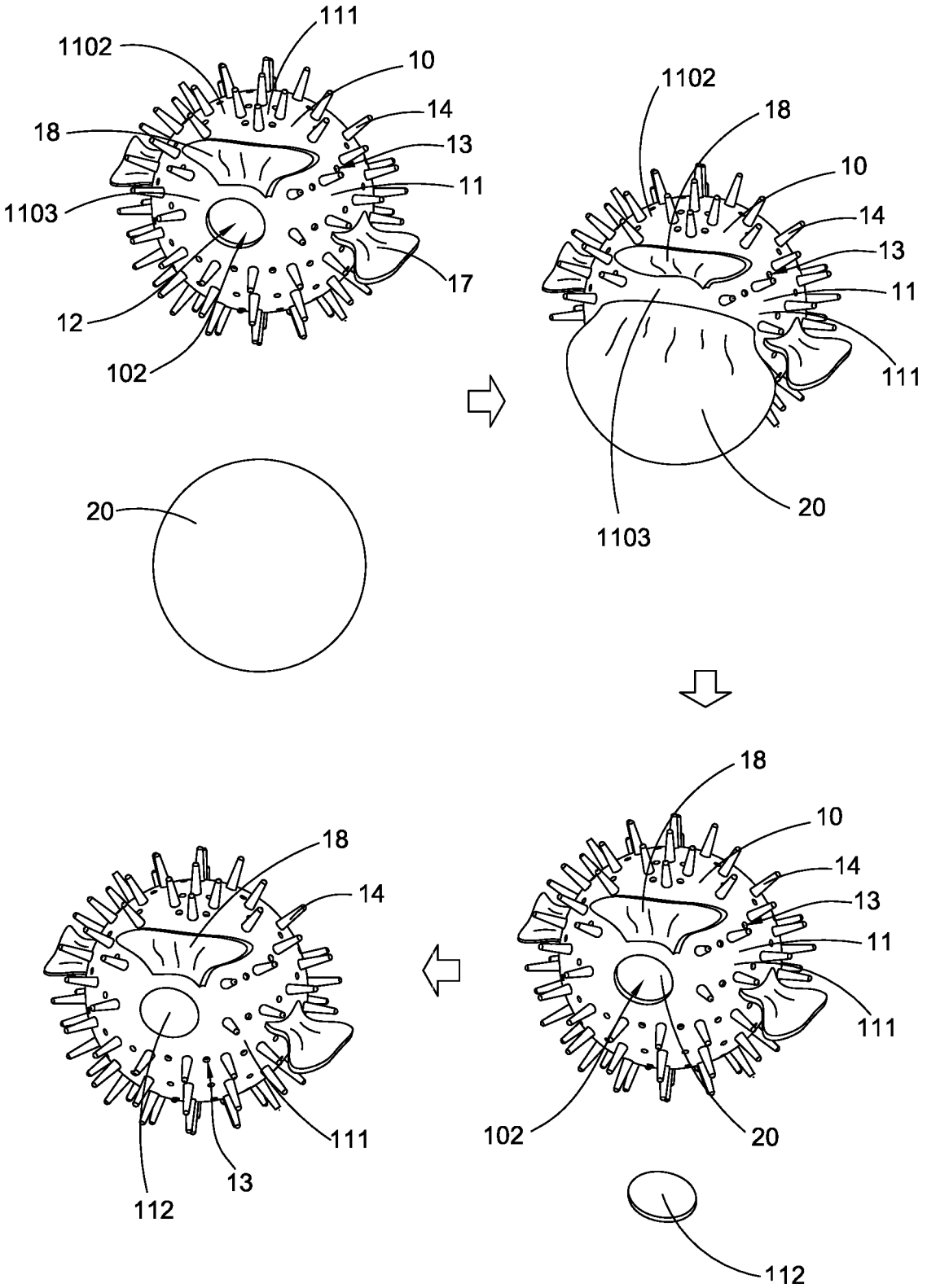
FIG. 8 is a schematic view illustrating a manufacturing process of the water splashing toy according to the above preferred embodiment of the present invention.

Referring to FIG. 5 and FIG. 8 of the drawings, the shell body 11 of the outer shell 10 of the water splashing toy comprises a cavity body portion 111 and a sealing portion 112, wherein the cavity body portion 111 is generally constructed to define the inner cavity 12, the cavity body portion 111 is connected to the sealing portion 112, so as to form an integral ball structure for receiving the inner water retaining bladder 20 therein.

In addition, as shown in FIGS. 4 to 6 of the drawings, the outer shell 10 of the water splashing toy is constructed to be a fish like structure comprising the shell body 11, a mouth portion 15, one or more eye portions 16, one or more pinna portions 17, and a tail portion 18. More specifically, the mouth portion 15 and two eye portions 16 are formed on the head area 1101 of the shell body 11 of the outer shell 10, the pinna portions 17 are formed on the middle surrounding area 1102 of the shell body 11 of the outer shell 10, and the tail portion 18 is formed on the end area 1103 of the shell body 11 of the outer shell 11.

According to this preferred embodiment, the material of the mouth portion 15, the pinna portions 17 and the tail portion 18 can be the same as the material of the shell body 11. In other words, the mouth portion 15, the pinna portions 17 and the tail portion 18 are integrally protruded from the shell body 11. Each of the eye portions 16 is attached to the shell body 11 by a glue and may be made of other plastic material and is configured to have a white outer circular portion 161 and a black inner portion 162 to imitate a real eyeball of the fish. Alternatively, the mouth portion 15, the pinna portions 17 and the tail portion 18 also can be made of material that is different from the material of the shell body 11, and are attached on the shell body 11.

Preferably, a color of the shell body 11 of the outer shell 10 is green. Alternatively, the shell body 11 of the outer shell 10 also can be configured to have other color.

The plurality of water passages 13 can be formed in any area of the shell body 11 of the outer shell 10. In this embodiment, as shown in FIGS. 4 to 6 of the drawings, the plurality of water passages 13 is formed in the middle surrounding area 1102 of the shell body 11 of the outer shell 10 and penetrating a thickness thereof for communicating the inner cavity 12 of the outer shell 10 to outside. As an example, a water passage 13 is formed between the two adjacent protrusions 14 in the middle surrounding area 1102 of the shell body 11. Preferably, the plurality of water passages 13 is evenly distributed in the middle surrounding area 1102 of the shell body 11.

Referring to FIG. 6 of the drawings, the inner water retaining bladder 20 is employed to hold or absorb water. In addition, when the inner water retaining bladder 20 is embedded into the outer shell 10, a water retaining space 101, is formed between the inner water retaining bladder 20 and the shell body 11 of the outer shell 10, so that the outer shell 10 is also able to hold the water in the gap around the inner water retaining bladder 20 within the shell body 11. Accordingly, a water holding capacity of the water splashing toy of the present invention is increased by a water absorption capacity of the inner water retaining bladder 20 and the water retaining space 101 between the inner water retaining bladder 20 and the shell body 11 of the outer shell 10.

Figure 7:
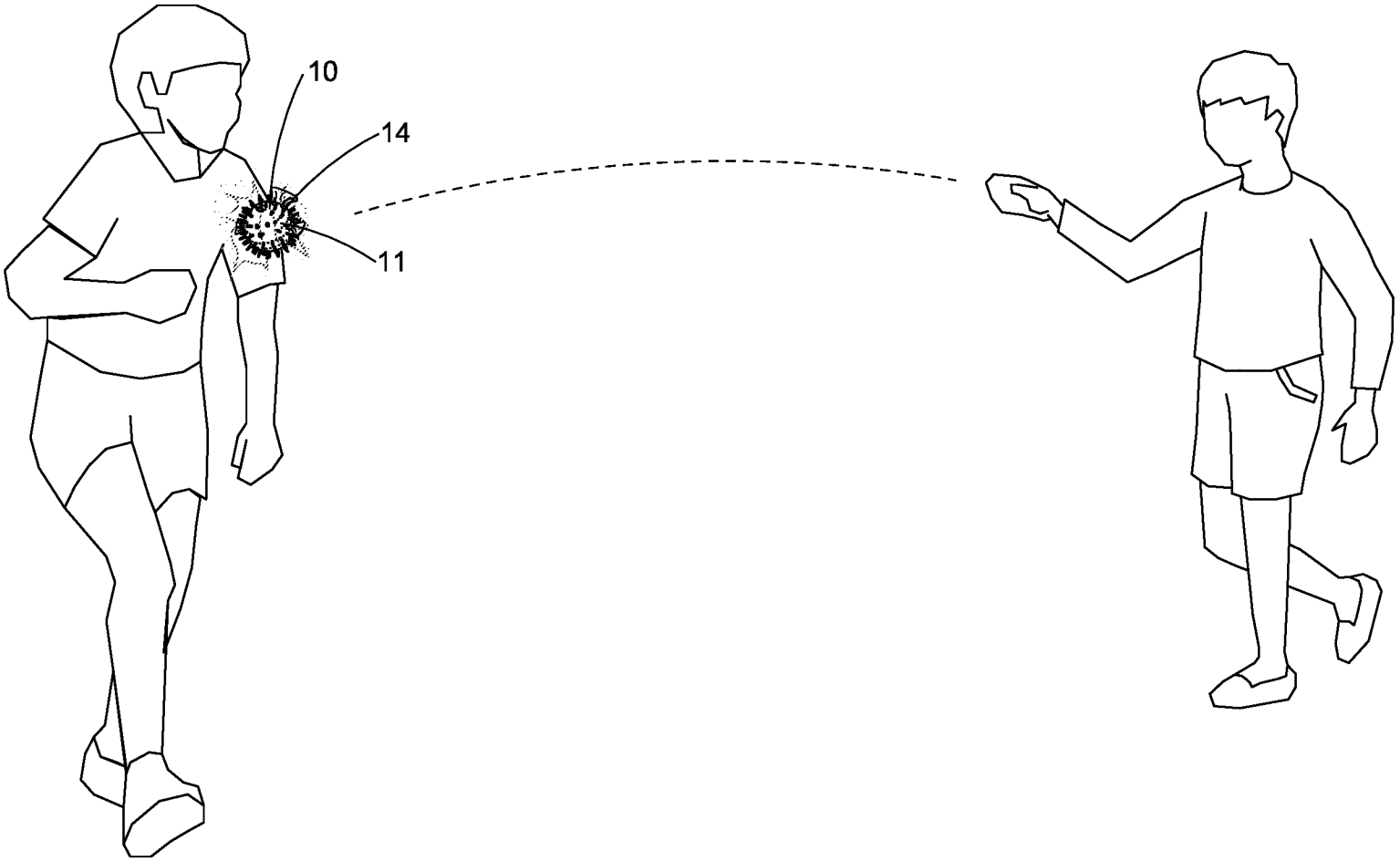
FIG. 7 is a schematic view illustrating the water splashing toy being played in a water splashing game according to the above preferred embodiment of the present invention.

There are many application scenarios of the water splashing toy of the present invention. The water splashing toy of this embodiment can be embodied as a water soaking ball or water bomb. A child may squeeze the water splashing toy in a bath tub, children and adults can play the water splashing toy in the water splashing or water fighting game, as shown in FIG. 7 of drawings.

When in use, the user is only required to hold the outer shell 10 and immerse the water splashing toy into water and squeeze the outer shell 10, both of the outer shell 10 and the inner water retaining bladder is pressed to be deformed, the air pressure in the outer shell 10 is reduced, so that when the user releases the water splashing toy in water, the inner water retaining bladder 20 automatically restores its shape, so as to drive the outer shell 10 to automatically restore its shape, and water can be sucked into the shell body 11 of the outer shell 10 through the plurality of water passages 13 in the shell body 11, and then water can be absorbed in the inner water retaining bladder 20, so that the water filling process is fast and the user can spend less time on the water filling of the water splashing toy.

Accordingly, water can be either retained on the inner water retaining bladder 20, or can be retained in the gap around the inner water retaining bladder 20 within the shell body 11, so that a single throw and impact of the water splashing toy on the body of the user will not drain out all of the water in the water splashing toy. In other words, the water splashing toy of the present invention can be played for multiple times after a single water filling step because water may residue in the inner water retaining bladder 20 or in the water retaining space 101 between the inner water retaining bladder 20 and the outer shell 10, so that after the water splashing toy is thrown out, the user can still pick it up for a next throw in the water splashing game. In addition, the playing site of the water splashing toy of the present invention is not only limited to be around the swimming pool or in the bath tub, the water splashing toy is filled with water in a water container such a water basin, and then the people can chase after each other and play on ground or on a lawn.

In addition, people, especially the children, will not get hurt or feel much pain when playing the water splashing toy of the present invention. The shell body 11 of the outer shell 10 is relatively soft and will bounce well on the body of the user and does not explode, the inner water retaining bladder 20 can function to provide a buffering effect to the outer shell 10, the plurality of protrusions 14 which will deform when having contact with the body of the user, so that the impact on the body of the user by the outer shell 10 of the water splashing toy will be not strong and is affordable and endurable by the user.

Referring to FIG. 8 of the drawings, a manufacturing method of the water splashing toy according to this preferred embodiment of the present invention is illustrated. The manufacturing method comprise an outer shell forming step, an inner water retaining bladder embedding step, and an outer shell sealing step.

More specifically, in the outer shell forming step, the soft, flexible and water-proof material is used to form the outer shell 10 comprising the shell body 11 having the inner cavity 12. The mouth portion 15, the pinna portions 17, and the tail portion 18 also can be integrally formed with the cavity body portion 111 of the shell body 11. The eye portions 16 can be attached on the cavity body portion 111 of the shell body 11.

The plurality of water passages 13 can be formed when forming the outer shell 10 in a forming process such as a mold injection process. Alternatively, after the the cavity body portion 111 of the shell body 11 is formed, e.g. several material sheet pieces are integrated with each other by glues or integrally combined through other integral joining manner, a hole drilling tool can be employed to process the cavity body portion 111 of the shell body 11 to provide the plurality of water passages 13.

In addition, an inserting opening 102 is formed at the end area 1103 in the cavity body portion 111 of the shell body 11 during the outer shell forming step for forming the outer shell 11 without the sealing portion 112.

In the inner water retaining bladder embedding step, the inner water retaining bladder 20 is squeezed and inserted into the cavity body portion 111 through the inserting opening 102, so as to dispose the inner water retaining bladder 20 within the cavity body portion 111 of the shell body 11.

In the outer shell sealing step, the sealing portion 112 is integrally joined to the cavity body portion 111 to seal the inserting opening 102, so as to form the integral shell body 11 which is a ball structure for housing the inner water retaining bladder 20. For example, the sealing portion 112 is glued to the cavity body portion 111.

Referring to FIGS. 9A to 9D of the drawings, a water splashing toy according to a first alternative mode of the above preferred embodiment of the present invention is illustrated. Similarly, the water splashing toy comprises an outer shell 10 and an inner water retaining bladder 20 disposed in the outer shell 10, wherein the inner water retaining bladder 20 is capable of absorbing water, so as to hold the water in the outer shell 10.

More specifically, as shown in FIGS. 9A to 9D, the outer shell 10 comprises a shell body 11 defining an inner cavity 12 and having a plurality of water passages 12 formed in the shell body 11, wherein the plurality of water passages 13 is communicated with the inner cavity 12 for allowing water to enter in the inner cavity 12 or be squeezed out of the outer shell 10. The shell body 11 of this embodiment comprises two shell sections 113, such as to sell halves comprising a first shell half 1131 and a second shell half 1132, defining the inner cavity 12.

The shell body 11 is constructed to be a ball, a plurality of protrusions 14 is integrally formed on an outer surface 1104 thereof, a plurality of bumps 19 is integrally protruded from an inner surface 1105 thereof disposed between the inner water retaining bladder 20 and the inner surface 1105 of the shell body 11 of the outer shell 10, so as to ensure the forming of the water retaining space 101 between the inner water retaining bladder 20 and the inner surface 1105 of the shell body 11 of the outer shell 10, as well as to provide a buffering effect when the outer shell 10 is hit on the body of the user.

Figure 9A:
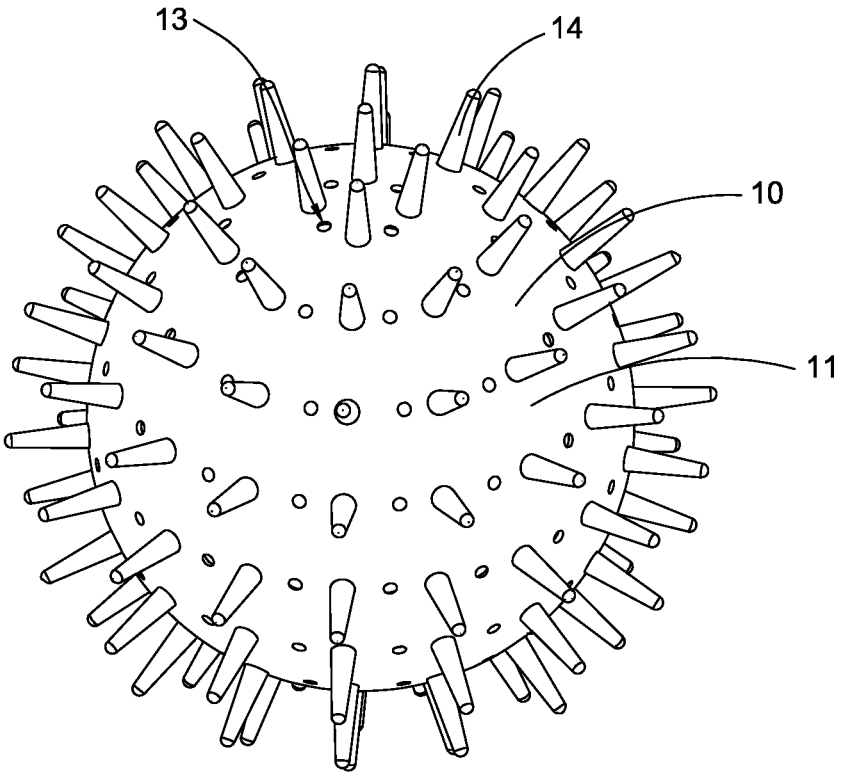
FIG. 9A is a perspective view of a water splashing toy according to a first alternative mode of the above preferred embodiment of the present invention.
Figure 9B:
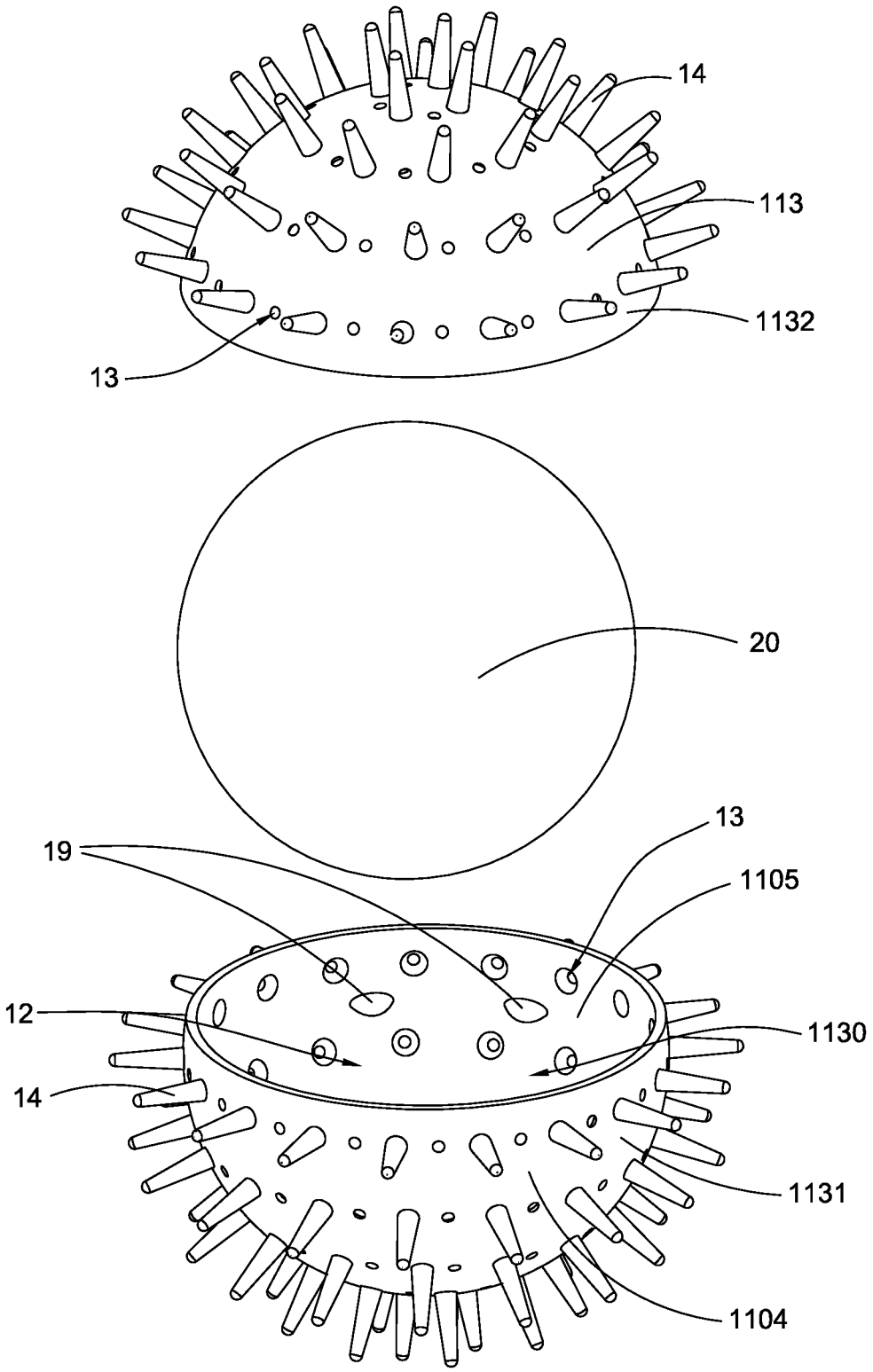
FIG. 9B is an exploded view of the water splashing toy according to the first alternative mode of the above preferred embodiment of the present invention.
Figure 9C:
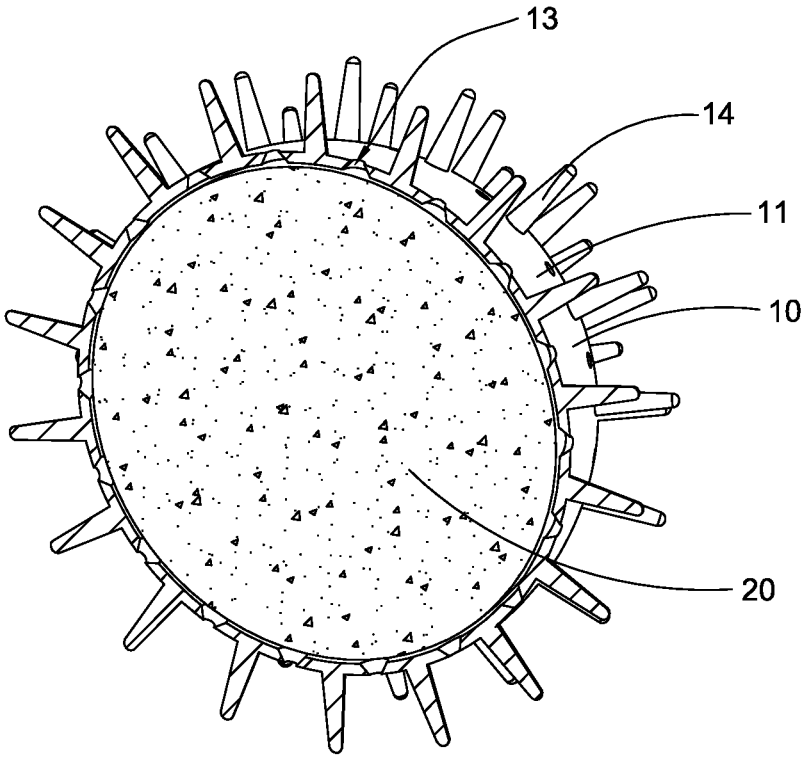
FIG. 9C is a sectional view of the water splashing toy according to the first alternative mode of the above preferred embodiment of the present invention.

As shown in FIG. 9C of the drawings, each of the water passages 13 is configured to be a conical passage having a diameter gradually increased from the outer surface 1104 of the shell body 11 to inner surface 1105 of the shell body 11, so as to increase a water ejecting speed and provide a varied water ejection pattern than the regular cylindrical passage in FIGS. 4 to 6, so as to enhance a water ejection and splashing performance.

Figure 9D:
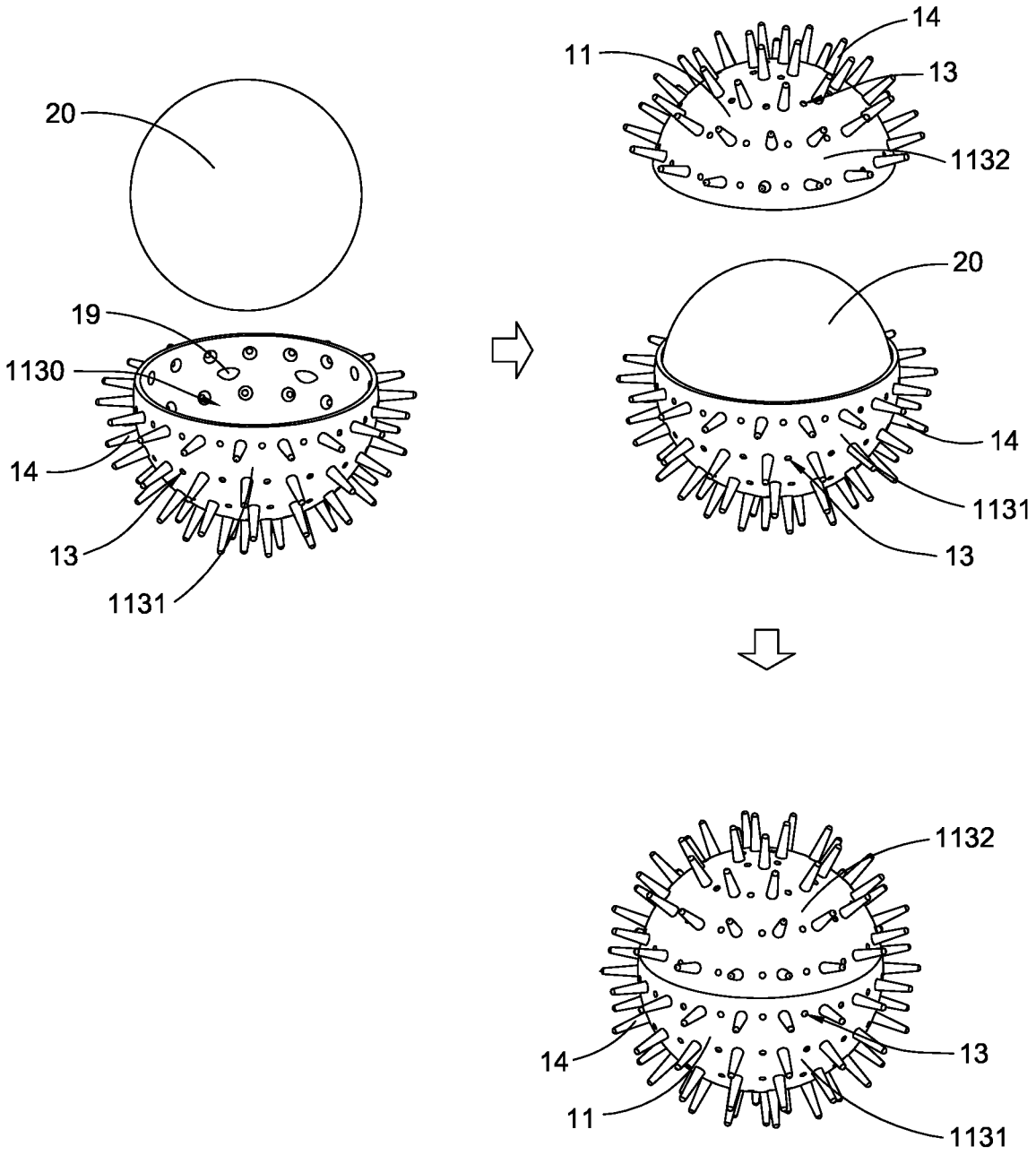
FIG. 9D is a schematic view illustrating a manufacturing process of the water splashing toy according to the first alternative mode of the above preferred embodiment of the present invention.
Figure 10A:
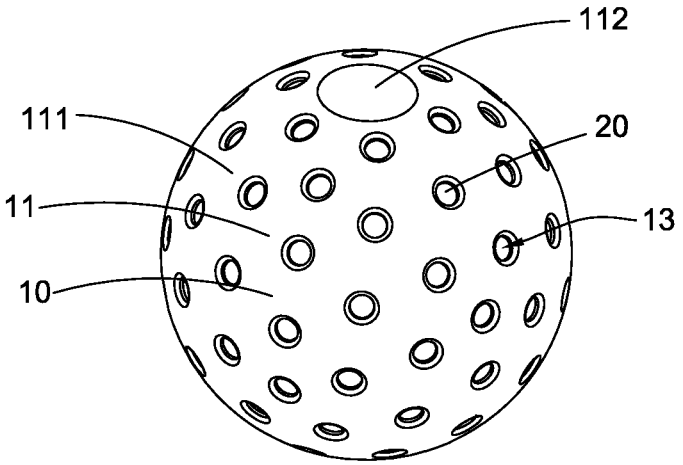
FIG. 10A is a perspective view of a water splashing toy according to a second alternative mode of the above preferred embodiment of the present invention.
Figure 10B:
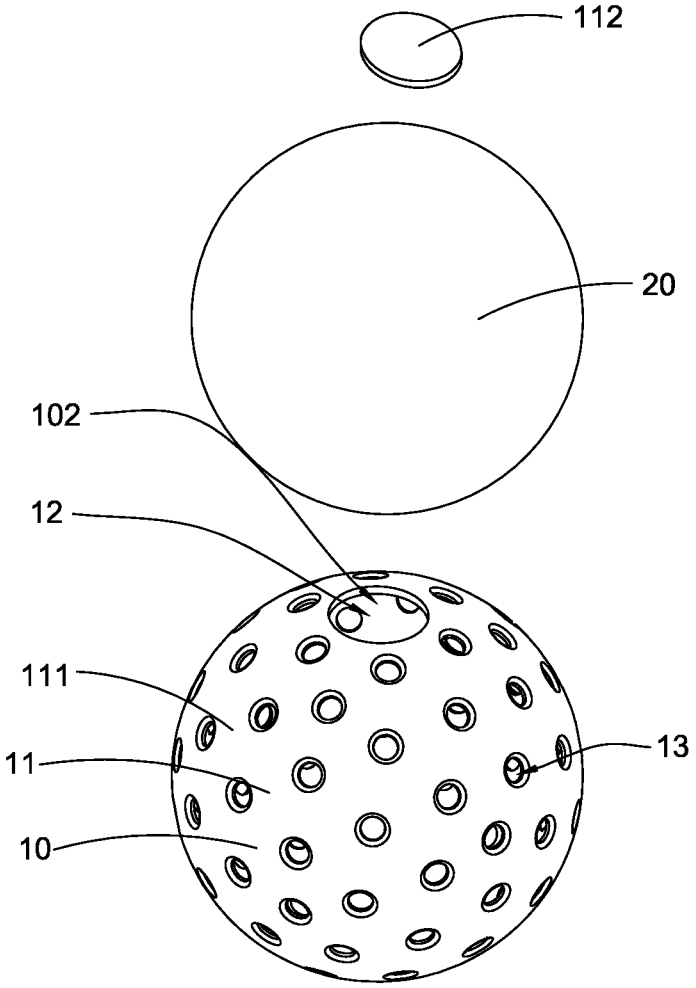
FIG. 10B is an exploded view of the water splashing toy according to the second alternative mode of the above preferred embodiment of the present invention.

Referring to FIG. 9D of the drawings, a manufacturing method of the water splashing toy according to this preferred embodiment of the present invention is illustrated. The manufacturing method comprise an outer shell forming step, an inner water retaining bladder embedding step, and an outer shell sealing step.

More specifically, in the outer shell forming step, the soft, flexible and water-proof material is used to form the shell body 11 of the outer shell 10 having the plurality of water passages 13 and comprising the protrusions 14 and the bumps 19, wherein the shell body 11 comprise the first shell half 1131 and the second shell half 1132 each having a receiving chamber 1130.

In the inner water retaining bladder embedding step, the inner water retaining bladder 20 is placed in the receiving chamber 1130 of the first shell half 1131 of the shell body.

In the outer shell sealing step, the second shell half 1132 is placed on the first shell half 1131 to define the inner cavity 12 by the two receiving chambers 1130 of the two second halves 1131 and 1132, and the second half 1132 is integrally joined to the first shell half 1131, so as to form the integral shell body 11 which is a ball structure for housing the inner water retaining bladder 20.

Figure 11:
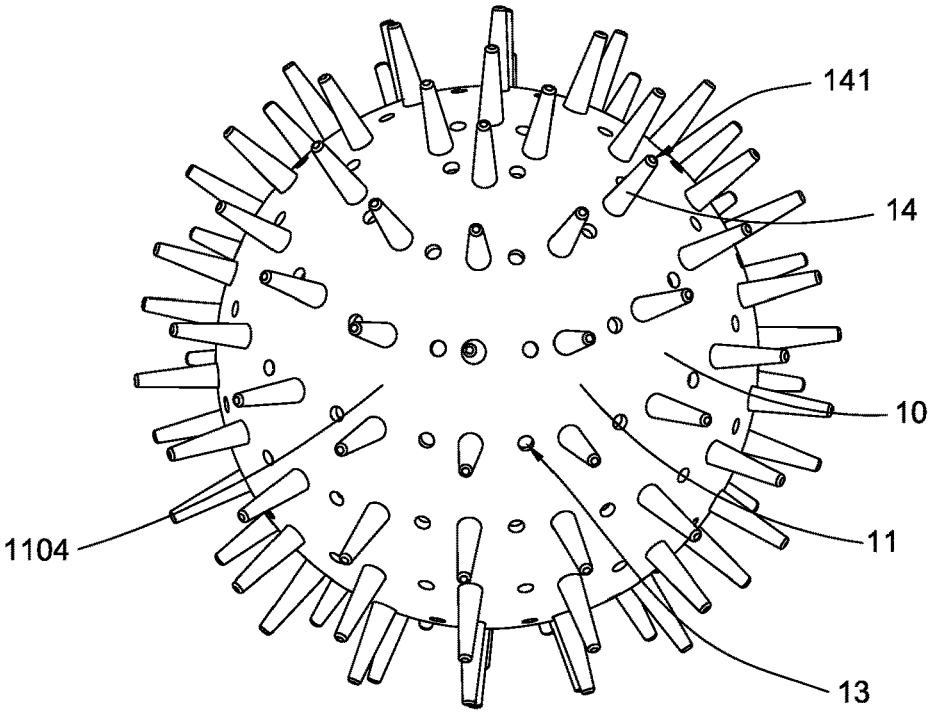
FIG. 11 is a perspective view of a water splashing toy according to a third alternative mode of the above preferred embodiment of the present invention.

Referring to FIG. 11 of the drawings, a water splashing toy according to a second alternative mode of the above preferred embodiment of the present invention is illustrated. Similarly, the water splashing toy comprises an outer shell 10 and an inner water retaining bladder 20 disposed in the outer shell 10.

The outer shell 10 comprises a shell body 11 defining an inner cavity 12 and having a plurality of water passages 12 formed in the shell body 11, wherein the plurality of water passages 13 is communicated with the inner cavity 12 for allowing water to enter in the inner cavity 12 or be squeezed out of the outer shell 10. The shell body comprises In this embodiment, the water splashing toy is embodied as a water splashing ball. In other words, no protrusions 14 are formed on the shell body 11 which is a ball body comprising a cavity body portion 111 and a sealing portion 112 for sealing an inserting opening 102 which is used for inserting the inner water retaining bladder 20.

Referring to FIG. 11 of the drawings, a water splashing toy according to a third alternative mode of the above preferred embodiment of the present invention is illustrated. Similarly, the water splashing toy comprises an outer shell 10 and an inner water retaining bladder 20 disposed in the outer shell 10.

The outer shell 10 comprises a shell body 11 defining an inner cavity 12 and having a plurality of water passages 12 formed in the shell body 11, wherein the plurality of water passages 13 is communicated with the inner cavity 12 for allowing water to enter in the inner cavity 12 or be squeezed out of the outer shell 10.

A plurality of protrusions 14 is integrally formed on an outer surface 1104 of the shell body 11. According this preferred embodiment, a plurality of water channels 141 is formed in one or more of the protrusions 14 for communicating with the inner cavity 12 of the outer shell 10. Each of the plurality of water channels 141 can be formed as a conical channel having a diameter gradually reduced from an approximate end of adjacent to the outer surface 1104 of the shell body 11 to a distal end away from the outer surface 1104 of the shell body 11 for forming a varied water ejection pattern than the water passages 13.

Alternatively, in other embodiments, the shell body 11 may not be formed with the water passages 13 while the outer shell 10 only has the water channels 141 formed in the protrusions 14.

Figure 12:
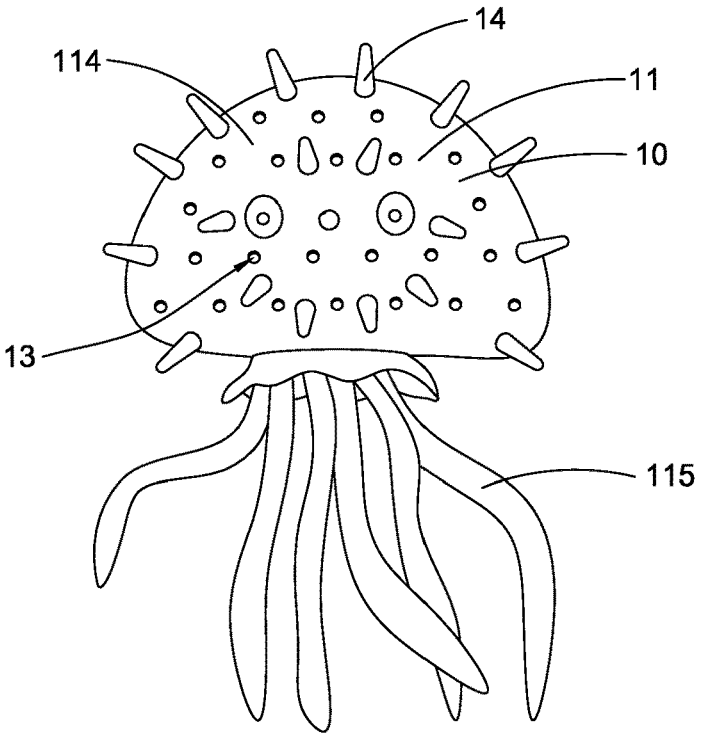
FIG. 12 is a perspective view of a water splashing toy according to a fourth alternative mode of the above preferred embodiment of the present invention.
Figure 13:
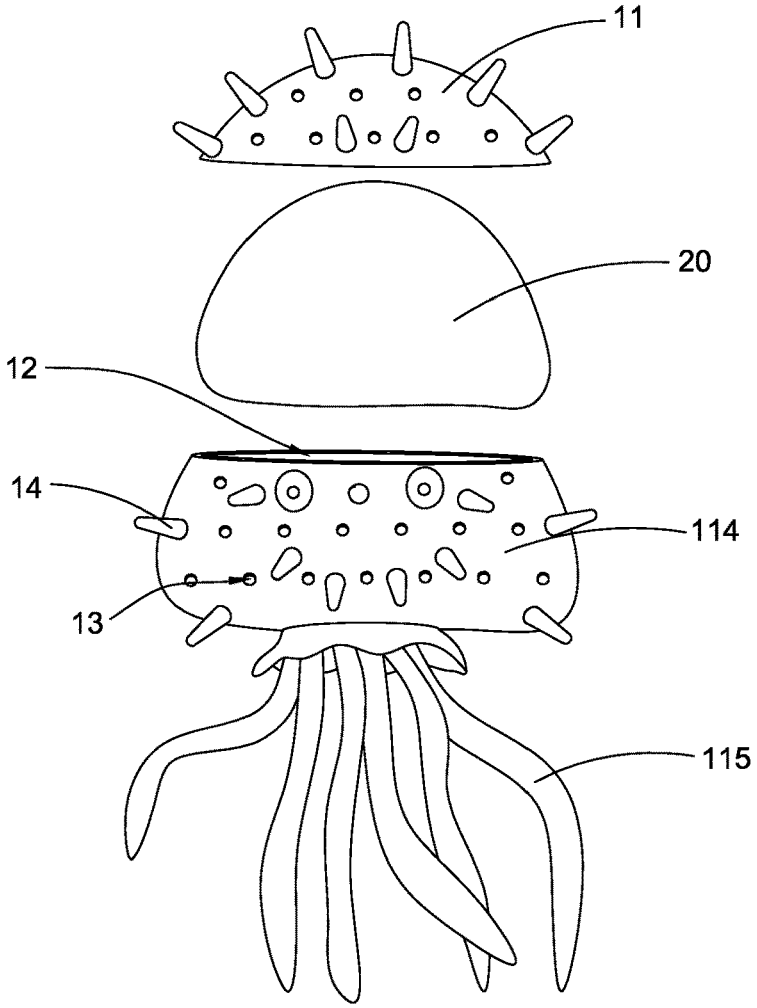
FIG. 13 is an exploded view of the water splashing toy according to the fourth alternative mode of the above preferred embodiment of the present invention.

Referring to FIG. 12 to FIG. 13 of the drawings, a water splashing toy according to a fourth alternative mode of the above preferred embodiment of the present invention is illustrated. Similarly, the water splashing toy comprises an outer shell 10 and an inner water retaining bladder 20 disposed in the outer shell 10.

The outer shell 10 is construed to have a configuration of an aquatic animal. More specifically, in this embodiment, the outer shell 10 is construed to be like an octopus. Accordingly, the shell body 11 of the outer shell 10 comprises an octopus body portion 114 defining an inner cavity 12 and a plurality of tentacle portions 115 integrally extended from the octopus body portion 114. The inner water retaining bladder 20 is correspondingly shaped and sized to be fitted into the inner cavity 12 of the octopus body portion 114.

Similarly, the octopus body portion 114 is formed with a plurality of water passages 13 for suction of water as well as water ejection, and a plurality of protrusions 14 may be integrally formed on the octopus body portion 114.

Figure 14:
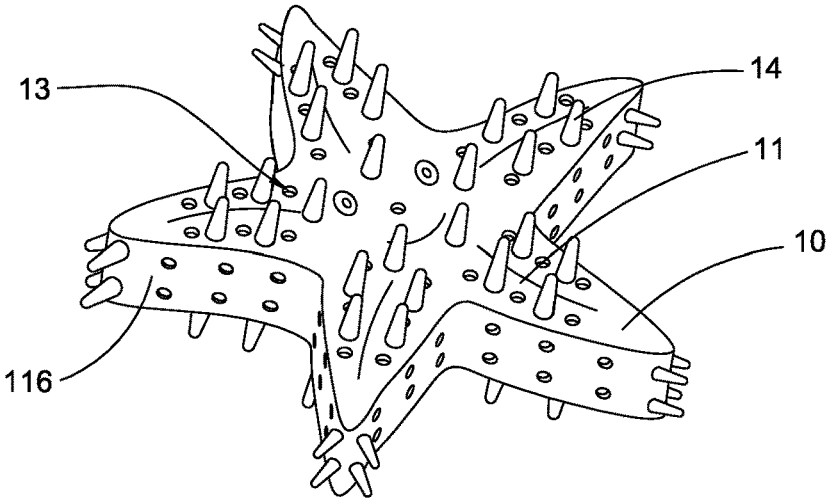
FIG. 14 is a perspective view of a water splashing toy according to a fifth alternative mode of the above preferred embodiment of the present invention.
Figure 15:
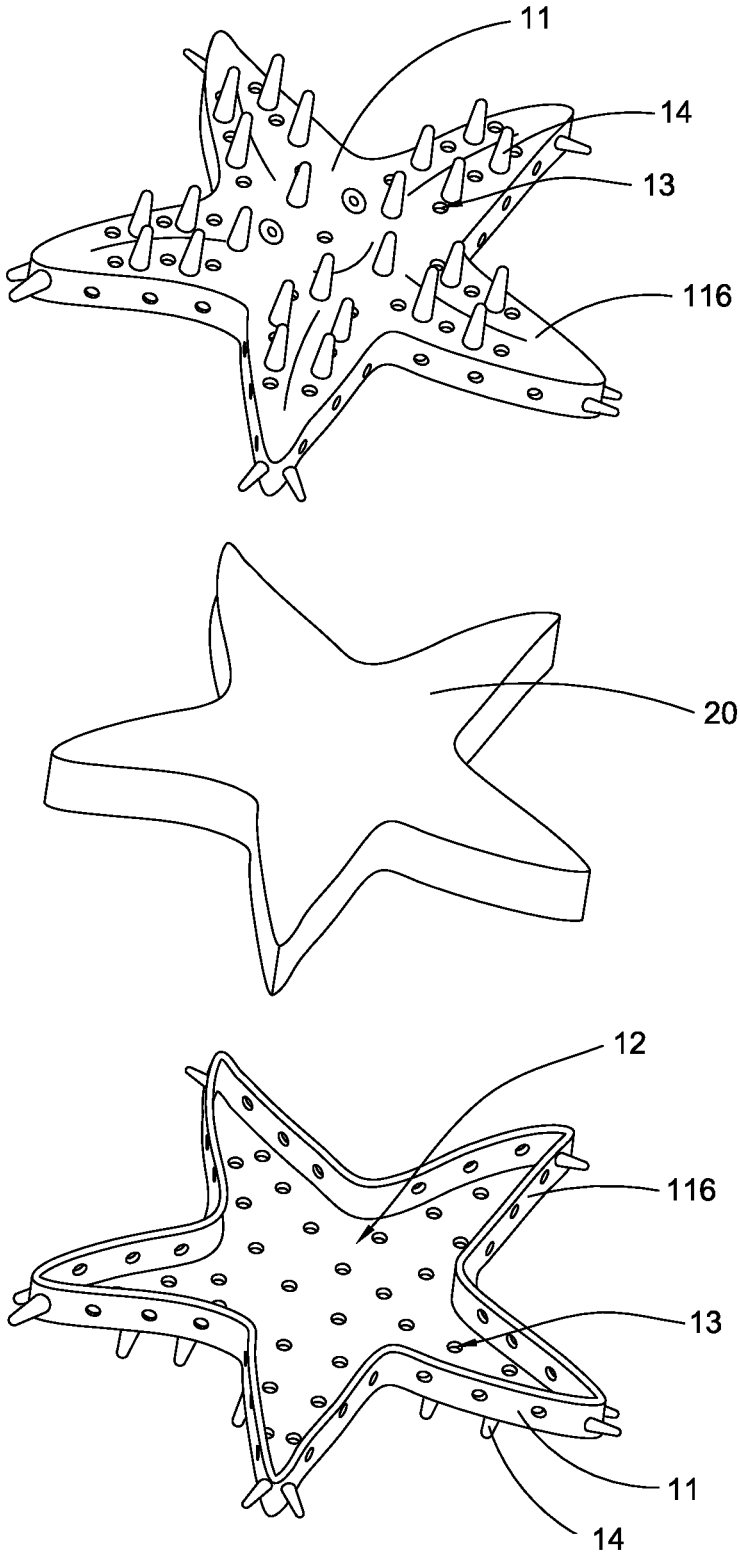
FIG. 15 is an exploded view of the water splashing toy according to the fifth alternative mode of the above preferred embodiment of the present invention.

Referring to FIG. 14 to FIG. 15 of the drawings, a water splashing toy according to a fifth alternative mode of the above preferred embodiment of the present invention is illustrated. Similarly, the water splashing toy comprises an outer shell 10 and an inner water retaining bladder 20 disposed in the outer shell 10.

In this embodiment, the outer shell 10 is construed to be like a starfish. Accordingly, the shell body 11 of the outer shell 10 comprises a starfish body portion 116 defining an inner cavity 12. Similarly, the starfish body portion 116 is formed with a plurality of water passages 13 for suction of water as well as water ejection, and a plurality of protrusions 14 may be integrally formed on the starfish body portion 116. The inner water retaining bladder 20 is correspondingly constructed to have a starfish shape, so as to be fitted into the inner cavity 12 of the starfish body portion 116.

Figure 16:
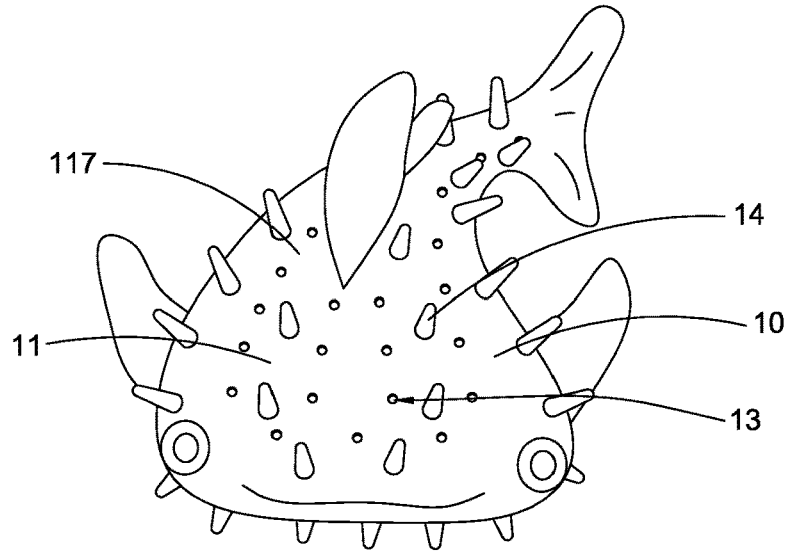
FIG. 16 is a perspective view of a water splashing toy according to a sixth alternative mode of the above preferred embodiment of the present invention.
Figure 17:
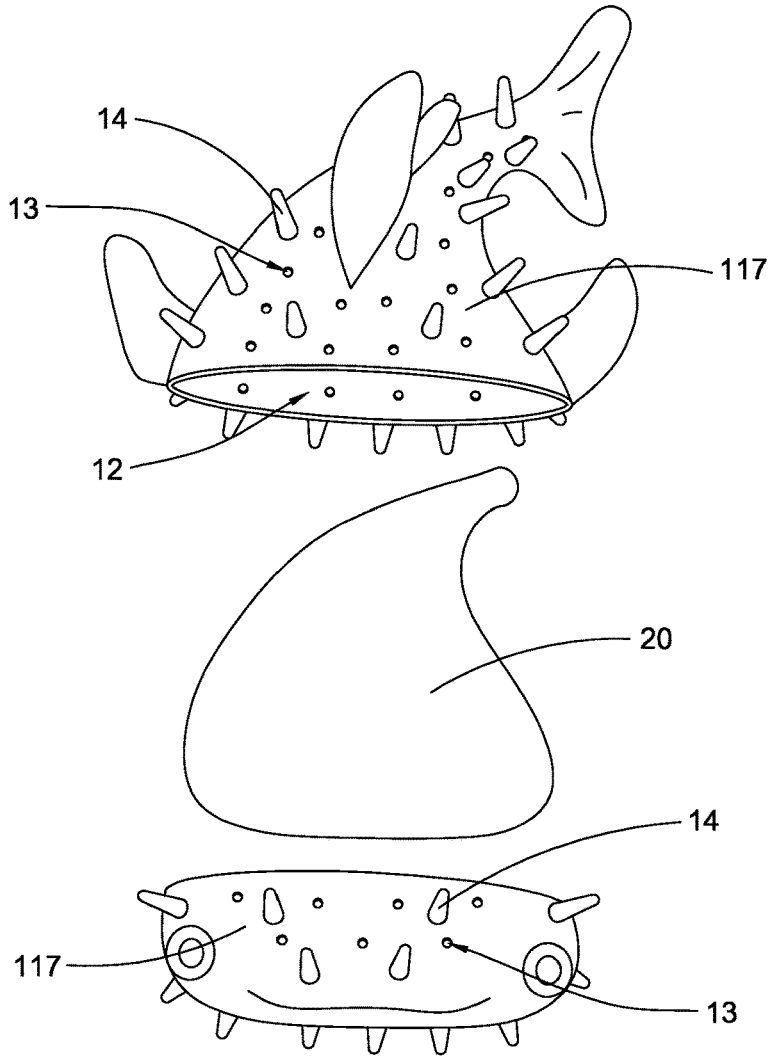
FIG. 17 is an exploded view of the water splashing toy according to the sixth alternative mode of the above preferred embodiment of the present invention.

Referring to FIG. 16 to FIG. 17 of the drawings, a water splashing toy according to a sixth alternative mode of the above preferred embodiment of the present invention is illustrated. Similarly, the water splashing toy comprises an outer shell 10 and an inner water retaining bladder 20 disposed in the outer shell 10.

In this embodiment, the outer shell 10 is construed to be like a whale. Accordingly, the shell body 11 of the outer shell 10 comprises a whale body portion 117 defining an inner cavity 12. Similarly, the whale body portion 117 is formed with a plurality of water passages 13 for suction of water as well as water ejection, and a plurality of protrusions 14 may be integrally formed on the whale body portion 117. The inner water retaining bladder 20 is correspondingly constructed to have a whale shape, so as to be fitted into the inner cavity 12 of the whale body portion 117.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A water splashing toy, comprising:

an outer shell having an inner cavity and a plurality of water passages communicated to said inner cavity; and an inner water retaining bladder disposed in said inner cavity of said outer shell, wherein said outer shell comprises an shell body defining said inner cavity and a plurality of protrusions integrally protruded from an outer surface of said shell body;

wherein said shell body comprises a cavity body portion and a sealing portion connected to said cavity body portion to seal an inserting opening used for inserting said inner water retaining bladder into said inner cavity of said shell body.

2. A water splashing toy, comprising:

an outer shell having an inner cavity and a plurality of water passages communicated to said inner cavity; and an inner water retaining bladder disposed in said inner cavity of said outer shell, wherein said outer shell comprises a shell body, wherein a water retaining space is formed between said inner water retaining bladder and said shell body, wherein a water holding capacity of the water splashing toy is increased by a water absorption capacity of said inner water retaining bladder and said water retaining space between said inner water retaining bladder and said shell body of said outer shell.

3. A water splashing toy, comprising:

an outer shell having an inner cavity and a plurality of water passages communicated to said inner cavity; and an inner water retaining bladder disposed in said inner cavity of said outer shell, wherein said outer shell comprises an shell body defining said inner cavity and a plurality of protrusions integrally protruded from an outer surface of said shell body;

wherein a plurality of bumps is formed on an inner surface of said shell body.

4. A water splashing toy, comprising:

an outer shell having an inner cavity and a plurality of water passages communicated to said inner cavity; and an inner water retaining bladder disposed in said inner cavity of said outer shell, wherein said outer shell is constructed to be a fish like structure comprising a shell body defining said inner cavity, a mouth portion, one or more eye portions, one or more pinna portions, and a tail portion, wherein said mouth portion, said one or more eye portions, said one or more pinna portions, and said tail portion are formed on said shell body;

wherein said shell body comprises a head area, a surrounding area and an end area, wherein said surrounding area is integrally extended between said head area and said end area, wherein said mouth portion is integrally formed on said head area, said one or more pinna portions are integrally formed on said surrounding area, and said tail portion is formed on said end area, each of said said one or more eye portions, which is attached on said shell body, comprises a white outer circular portion and a black inner portion within said white outer circular portion to imitate a real eyeball of the fish, wherein a plurality of protrusions is integrally protruded from said surrounding area of said shell body.

5. A manufacturing method of a water splashing toy, comprising the following steps:

(a) forming a cavity body portion of a shell body having an inner cavity, a plurality of water passages communicated to said inner cavity, and an inserting opening communicated to said inner cavity;

(b) disposing an inner water retaining bladder into said inner cavity of said shell body through said inserting opening; and (c) sealing said inserting opening through a sealing portion which is connected to said cavity body portion to hide said inner water retaining bladder within said shell body.

6. The method according to claim 5, further comprising a step of integrally forming a plurality of protrusions on said shell body.

* * * * *